US008414141B2

(12) United States Patent
Lenderink et al.

(10) Patent No.: US 8,414,141 B2
(45) Date of Patent: Apr. 9, 2013

(54) LUMINAIRE FOR ILLUMINATING A SPACE UNDERNEATH A CEILING OR A CANOPY, AND METHOD OF ILLUMINATING SUCH A SPACE

(75) Inventors: Egbert Lenderink, Eindhoven (NL); Marco Van As, Eindhoven (NL); Lucas Leo Desiree Van Der Poel, Eindhoven (NL); Denis Joseph Carel Van Oers, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/934,691

(22) PCT Filed: Mar. 27, 2009

(86) PCT No.: PCT/IB2009/051290

§ 371 (c)(1),
(2), (4) Date: Sep. 27, 2010

(87) PCT Pub. No.: WO2009/122335

PCT Pub. Date: Oct. 8, 2009

(65) Prior Publication Data

US 2011/0013394 A1 Jan. 20, 2011

(30) Foreign Application Priority Data

Apr. 3, 2008 (EP) ..... 08153992

(51) Int. Cl.
*F21S 8/04* (2006.01)
*F21S 4/00* (2006.01)

(52) U.S. Cl. ..... 362/147; 362/311.02; 362/249.02; 362/217.14

(58) Field of Classification Search ..... 362/147, 362/148, 150, 235, 223, 224, 225, 240, 217.02, 362/217.14–217.17, 311.02, 249.02
See application file for complete search history.

(56) References Cited

U.S. PATENT DOCUMENTS

| | | | | |
|---|---|---|---|---|
| 4,928,209 | A | 5/1990 | Rodin | |
| 5,570,947 | A | 11/1996 | Felland | |
| 6,170,962 | B1 | 1/2001 | Wordin | |
| 7,029,148 | B2 | 4/2006 | White et al. | |
| 7,252,412 | B2 | 8/2007 | Wijbenga et al. | |
| 7,736,014 | B2 * | 6/2010 | Blomberg | 362/147 |
| 8,210,723 | B2 * | 7/2012 | Peck et al. | 362/311.02 |
| 2003/0025457 | A1 | 2/2003 | Tai | |
| 2004/0114355 | A1 | 6/2004 | Rizkin et al. | |
| 2006/0164833 | A1 | 7/2006 | Parkyn et al. | |
| 2006/0198144 | A1 | 9/2006 | Miyairi et al. | |
| 2008/0037239 | A1 | 2/2008 | Thomas et al. | |
| 2009/0175038 | A1 * | 7/2009 | Rooymans | 362/249.02 |

(Continued)

FOREIGN PATENT DOCUMENTS

| | | | |
|---|---|---|---|
| EP | 1758068 | A1 | 2/2007 |
| WO | 2004100624 | A2 | 11/2004 |
| WO | 2006067777 | A2 | 6/2006 |

*Primary Examiner* — Bao Q Truong
(74) *Attorney, Agent, or Firm* — Mark L. Beloborodov

(57) ABSTRACT

A luminaire for illuminating a space underneath a ceiling or a canopy (1) to which the luminaire (2,3) is attached. The luminaire (2,3) comprises a plurality of LEDs (31) positioned in a straight array, and an elongated convergent lens (30) which extends parallel to the array of LEDs (30). The array of LEDs (30) is located at a distance (D) from the plane of symmetry (33) of the elongated lens (30).

10 Claims, 2 Drawing Sheets

U.S. PATENT DOCUMENTS

2010/0118534 A1* 5/2010 Lo ..... 362/249.02
2010/0188849 A1* 7/2010 Luo et al. ..... 362/249.02
2011/0037411 A1* 2/2011 Bonyadi ..... 362/147

* cited by examiner

LUMINAIRE FOR ILLUMINATING A SPACE UNDERNEATH A CEILING OR A CANOPY, AND METHOD OF ILLUMINATING SUCH A SPACE

FIELD OF THE INVENTION

The invention relates to a luminaire for illuminating a space underneath a ceiling or a canopy to which the luminaire is attached, the luminaire comprising a plurality of LEDs (Light Emitting Diodes) positioned in a straight array, and an elongated convergent lens having a plane of symmetry, the elongated lens extending parallel to the array of LEDs. A convergent lens is a lens in which the beam of light passing through the lens becomes more convergent. The invention further relates to a method of illuminating a space underneath a ceiling or a canopy.

BACKGROUND OF THE INVENTION

When illuminating the space underneath a ceiling or a canopy, it is often required to direct the light radiation in such a way that light beams having a large angle of, for example, more than 60° with respect to the vertical direction are reduced or even completely blocked in order to avoid glare, i.e. bright light radiation dazzling persons at some distance from the location of the luminaire. In particular when the luminaire illuminates the space underneath the canopy of a petrol station or a space in which persons move in a preferential direction, glare has to be avoided in this direction, while it may be required to illuminate one or two side walls parallel to this preferential direction of movement. For example, such a space is also present in a tunnel through which people are walking or driving in cars.

Publication U.S. Pat. No. 7,252,412 describes such a luminaire for illuminating the space underneath a canopy of a petrol station. Glare dazzling drivers entering the petrol station is avoided with this luminaire, but light radiation in the transverse direction for illuminating the vertical surfaces of the petrol pumps has to be directed at relatively large angles to the vertical direction. The petrol pumps may be located on one or both sides of the driveway through the petrol station. If the petrol pumps are present on only one side of the driveway through the petrol station, the luminaire should only illuminate that side, whereas light radiation to the other side should be avoided, in particular when the road along which the petrol station is located is on this other side. Furthermore, it is desired to limit the light radiation in order to avoid waste of energy, i.e. to avoid light radiation outside the space underneath the canopy.

In order to avoid glare, the luminaire can be provided with louvers for blocking light radiation in certain directions. In order to increase or decrease the intensity of the light radiation in certain other directions, the luminaire can be provided with one or more light-reflecting surfaces having a specific shape, so that the light radiation is reflected to predetermined directions. Such a luminaire has the drawback of loss of effective light radiation emitted by the luminaire, so that a surplus of electric power is required.

When making use of LEDs in combination with refractive optics, i.e. a lens, a relatively efficient luminaire can be obtained, producing bright illumination with relatively low electric power supply. Such a luminaire is described in EP-A-1758068. This publication discloses an elongated luminaire provided with an elongated lens extending parallel to the array of LEDs, in which the array of LEDs and the lens have a common longitudinal plane of symmetry. The luminaire has an elongated U-shaped body whose bottom is provided with the straight array of LEDs. The elongated lens is clamped between the legs of the U-shaped body in order to obtain the desired light radiation emitted by the luminaire.

OBJECT AND SUMMARY OF THE INVENTION

It is an object of the invention to provide a luminaire for illuminating the space underneath a ceiling or a canopy, the luminaire comprising a plurality of LEDs in a straight array, and an elongated convergent lens, wherein light radiation to one side of the vertical plane through the array of LEDs is reduced.

It is another object of the invention to provide a luminaire for illuminating the space underneath a ceiling or a canopy, the luminaire comprising a plurality of LEDs in a straight array, and an elongated convergent lens, in which light radiation having relatively large angles with respect to the vertical direction is intensified towards one side of the vertical plane through the array of LEDs.

It is a further object of the invention to provide a luminaire for illuminating the space underneath a ceiling or a canopy, the luminaire comprising a plurality of LEDs in a straight array, and an elongated convergent lens parallel to the array of LEDs, wherein light radiation having relatively large angles with respect to the vertical direction and being substantially parallel to the vertical plane through the array of LEDs is reduced in order to avoid glare.

It is yet another object of the invention to provide a luminaire for illuminating the space underneath a ceiling or a canopy, the luminaire comprising a plurality of LEDs in two parallel straight arrays, wherein each array of LEDs is provided with an elongated convergent lens parallel to the array of LEDs, and light radiation having relatively large angles with respect to the vertical direction is intensified towards both sides of the vertical plane through the array of LEDs.

It is yet a further object of the invention to provide a luminaire for illuminating the space underneath a ceiling or a canopy, the luminaire comprising a plurality of LEDs in two parallel straight arrays, wherein each array of LEDs is provided with an elongated convergent lens parallel to the array of LEDs, and light radiation having relatively large angles with respect to the vertical direction and being substantially parallel to the vertical plane through the array of LEDs is reduced in order to avoid glare.

To achieve one or more of these objects, the LEDs are located at a distance D>0 mm from said plane of symmetry of the elongated lens. An asymmetric distribution of the light radiation with respect to the plane of symmetry of the elongated lens is thereby obtained. The light radiation does not only have an asymmetric distribution with respect to the plane of symmetry of the lens, but also an asymmetric distribution with respect to the central plane of the light beam from the elongated lens. The light intensity on one side of this central plane is much higher than the light intensity on the other side, in particular light radiation having a relatively large angle with respect to this plane. When the luminaire illuminates the space underneath the canopy of a petrol station, the petrol pumps will thus be illuminated in a convenient manner. Furthermore, it has been found that glare (light radiation having relatively large angles with respect to the vertical direction) in directions substantially parallel to a vertical plane through the array of LEDs is considerably reduced or even completely avoided.

In a preferred embodiment, the lens facing away from the array of LEDs has a convex cylindrical surface, preferably with a radius of between 5 mm and 15 mm. The lens facing the array of LEDs has a preferably concave cylindrical surface, preferably with a radius of between 15 mm and 30 mm. Cylindrical is herein understood to mean substantially the surface of a cylinder; small deviations of the surface of a cylinder will not annihilate the envisaged effect of distribution of the light radiation.

In a preferred embodiment, at least a part of each LED is located between the edges of the concave cylindrical surface of the elongated lens, so that the array of LEDs is positioned close to the elongated lens, so that all light radiation, or almost all light radiation, of the LEDs is directly emitted towards the elongated lens.

The array of LEDs preferably accommodates at least five LEDs. Such a number of bright shining LEDs provides effective illumination of the space underneath a canopy.

In a preferred embodiment, the distance between the central axes of the array of LEDs and the plane of symmetry of the elongated lens is at least 1 mm, preferably at least 3 mm. The elongated lens preferably has a width of between 15 mm and 30 mm, and the distance between the LEDs and the surface of the lens facing the LEDs is preferably less than 6 mm, more preferably less than 3 mm. It has been found that such dimensions provide effective distribution of the light radiation, in particular when the luminaire is used to illuminate the space underneath the canopy of a petrol station.

If the light radiation has to be directed mainly towards only one side of the longitudinal vertical plane through the luminaire, a preferred embodiment of the luminaire comprises only one straight array of LEDs and is provided with fastening means for fixing the luminaire to the canopy or the ceiling, which fastening means are located in a plane of attachment of the luminaire, while the angle between the plane of symmetry of the elongated lens and said plane of attachment is less than 90°, preferably less than 86° and more preferably between 76° and 86°, and the array of LEDs is located on the side of said plane of symmetry of the lens where the lens is closer to the front side of the luminaire. The longitudinal direction of the luminaire is the direction of the array of LEDs, and the front side of the luminaire is the side where the light radiation is emitted. A convenient illumination underneath the luminaire and to one side of a vertical plane through the luminaire is achieved with an embodiment in which the angle between the plane of symmetry of the elongated lens and said plane of attachment is between 79° and 83°.

If both sides of the longitudinal vertical plane through the luminaire have to be illuminated, a further preferred embodiment of the luminaire comprises two parallel arrays of LEDs, while each array of LEDs is provided with an elongated lens (as described hereinbefore) each having a plane of symmetry, and the two arrays of LEDs are located on different sides of said planes of symmetry of the lens with which the array of LEDs is associated. Both arrays of LEDs are thus located between the two planes of symmetry of the lenses, or each array of LEDs is located on the side of the plane of symmetry facing away from the other plane of symmetry. Each array of LEDs illuminates mainly another side of the space underneath the luminaire, so that the whole area underneath the luminaire is illuminated.

The two planes of symmetry of the two parallel elongated lenses may be positioned parallel to each other. However, in a preferred embodiment, the two planes of symmetry of the elongated lenses are positioned at an angle with respect to each other, which angle is between 8° and 28°, and preferably between 14° and 22°. In a preferred embodiment, the two planes of symmetry cross each other in a line behind the LEDs, so that each array of LEDs illuminates a side underneath the luminaire which is the same as the side where the array is located in the luminaire.

In a preferred embodiment, the luminaire has a plane of symmetry, and the two LEDs/lens combinations are identical to each other. This plane of symmetry extends in the vertical direction when the luminaire is attached to a ceiling or a canopy. The luminaire for illuminating one side of the space underneath it may have the same light source (LEDs/lens combination) as the luminaire for illuminating both sides, which luminaire is provided with two of such light sources.

The invention further relates to a method of illuminating a space underneath a ceiling or a canopy to which a luminaire is attached, the luminaire comprising a plurality of LEDs positioned in a straight array, and an elongated convergent lens having a plane of symmetry, the elongated lens extending parallel to the array of LEDs, wherein the LEDs are located at a distance from said plane of symmetry of the lens. The luminaire is preferably fixed to the ceiling or canopy, while the plane of symmetry of the elongated lens extends at an angle to the vertical direction, preferably an angle between 4° and 14°.

BRIEF DESCRIPTION OF THE DRAWINGS

The invention will now be elucidated with reference to a description of an embodiment of a luminaire for illuminating the space underneath a petrol station, and with reference to the drawing, in which.

DESCRIPTION OF EMBODIMENTS

Figure 1:
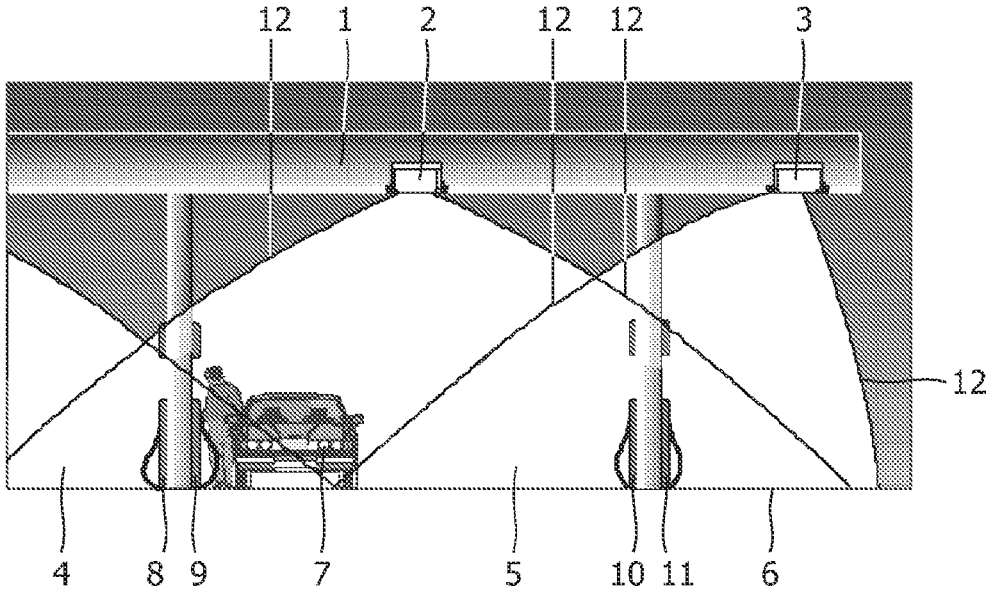
FIG. 1 is a schematic view of a petrol station in the drive-through direction.

FIG. 1 shows a petrol station having a canopy 1 provided with luminaires 2,3 for illuminating the space underneath the canopy 1. There are driveways 4,5,6 for a car 7 driving through the petrol station in order to be supplied with fuel. There are petrol pumps 8,9,10,11 on the sides of the driveways 4,5,6. Driveway 6 has a petrol pump 11 on only one side and the other side is open, where there may be the road along which the petrol station is located. Driveway 5 has petrol pumps 9,10 on both sides.

The luminaires 2,3 illuminate the driveways 5,6 and the petrol pumps 9,10,11 as is indicated by solid lines 12, showing the light beam of the respective luminaire. Luminaire 2 emits light radiation which is symmetrical with respect to the longitudinal vertical plane through the luminaire, i.e. the vertical plane in the driving direction, which is perpendicular to the plane of the drawing. The petrol pumps 9,10 on both sides of driveway 5 are illuminated by luminaire 2. The luminaire 3 emits an asymmetric light radiation pattern, i.e. different light radiation on the two sides of the longitudinal vertical plane through the luminaire, with the light being substantially emitted on only one side of said vertical plane, illuminating the petrol pump 11.

In the embodiment described, the luminaire 2,3 emits a beam 12 of light with a high light intensity in directions having a relatively large angle with respect to the vertical longitudinal plane through the luminaire, and a lower intensity in directions having a smaller angle with respect to the vertical longitudinal plane. Consequently, the petrol pumps 9,10,11 are illuminated more intensively than the driveways 5,6.

Figure 2:
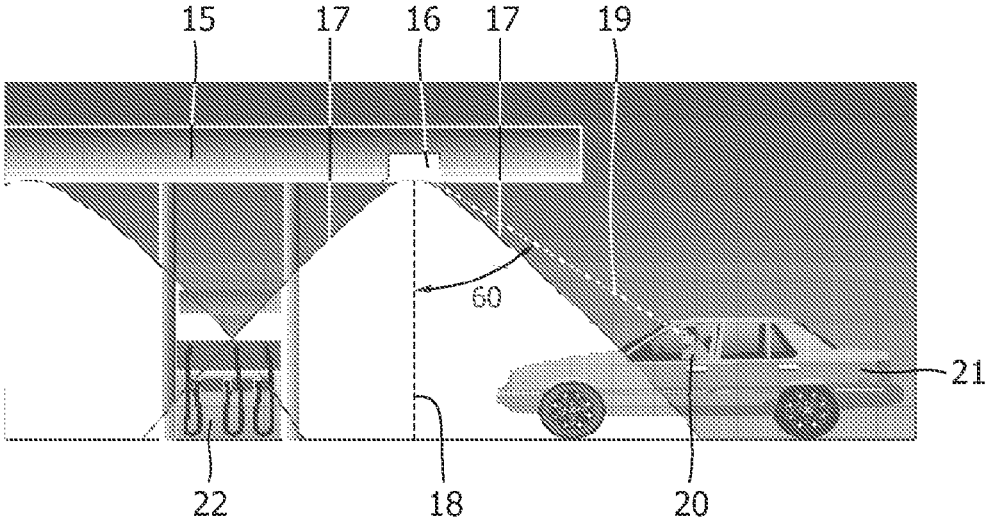
FIG. 2 is a schematic view of the petrol station perpendicular to the drive-through direction.

FIG. 2 shows schematically the petrol station, wherein the driving direction is parallel to the plane of the drawing. The canopy 15 is provided with a luminaire 16, and the beam of light emitted by luminaire 16 is indicated by solid lines 17. In the plane of the drawing (the longitudinal vertical plane of the luminaire 16) the maximum angle of the light radiation with respect to the vertical direction (broken line 18) is relatively small, in particular smaller than 60°, which angle is indicated by broken line 19. Consequently, the light radiation of the luminaire 16 is not inconvenient to the eyes of a driver 20 entering the petrol station in his car 21 in order to fill the fuel tank of his car 21 with fuel delivered by the petrol pump 22.

Figure 3:
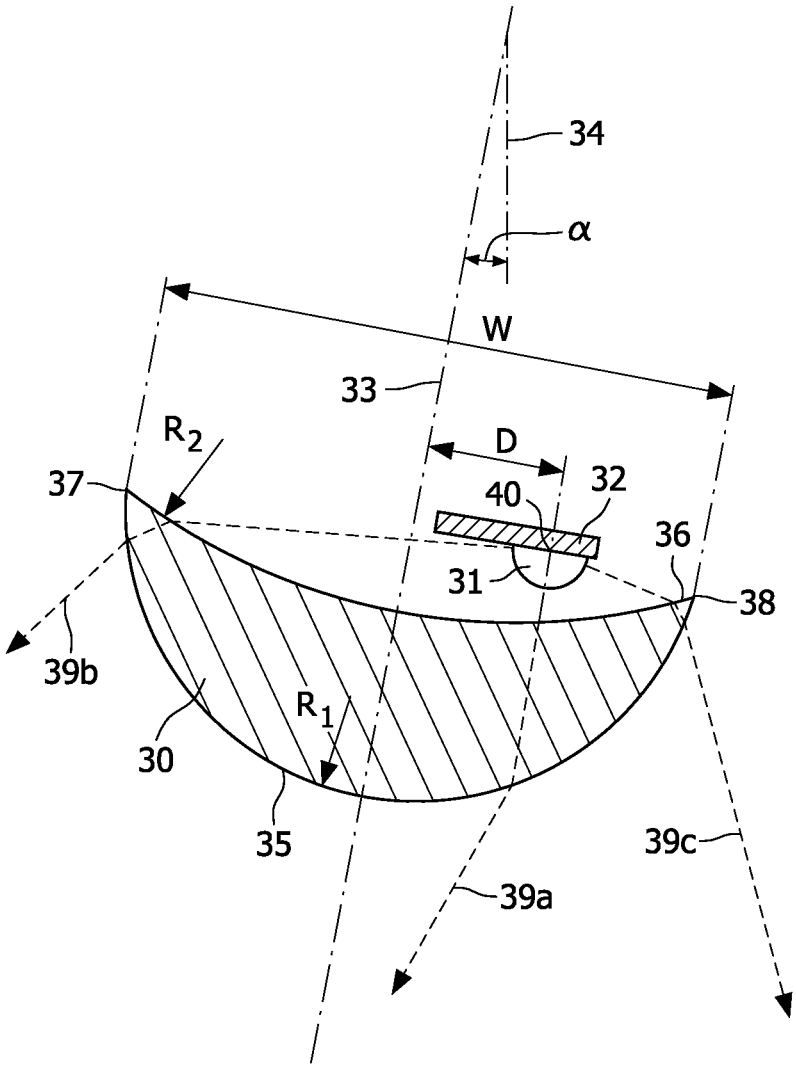
FIG. 3 shows schematically the positioning of the LEDs with respect to the elongated lens.

FIG. 3 is a diagrammatic cross-sectional view of an elongated convergent lens 30 and a LED 31 which is fixed to an elongated strip 32 to which an array of LEDs is attached. The array of LEDs is directed perpendicularly to the plane of the drawing, parallel to the elongated lens 30. The lens 30 and the array of LEDs 31 are mounted in the luminaire in the position as shown in FIG. 3. The plane of symmetry of the lens 30, indicated by dot-and-dash line 33, is positioned at an angle $\alpha$ to the vertical direction, indicated by dot-and-dash line 34.

The embodiment shown may have the following dimensions. The angle $\alpha$ between the plane of symmetry of the lens 30 and the vertical direction is 9°. The convex surface 35 of the elongated lens 30 has a cylindrical shape with a radius R1 of 10 mm, and the concave surface 36 of the lens 30 has a cylindrical shape with a radius R2 of 20 mm. The elongated lens 30 has a width W of 20 mm, and the distance D between the plane of symmetry of the lens and the center of the LED 31 is 5 mm. The LED 31 is located in the plane through the two parallel edges 37,38 of the lens 30, where the convex surface 35 and the concave surface 36 meet each other. The lens 30 (its dimension perpendicular to the plane of the drawing) has a length of 200 mm, and the array parallel to the lens 30 accommodates twenty-two LEDs.

In FIG. 3, the broken lines 39*a*, 39 *b* and 39*c* indicate light radiation from the LED 31 of which line 39*a* extends through a centre of 40 of the LED 31, showing that the major portion of the light radiation is directed to the left in the Figure, while the light has a relatively large intensity in directions having larger angles with respect to the vertical direction (line 34).

The dimensions mentioned above are examples only, but have resulted in a luminaire emitting an effective radiation of light for illuminating the space underneath the canopy of a petrol station, as described with reference to FIGS. 1 and 2. The luminaire may comprise one or two elongated lenses 30, while the two lenses 30, together with their associated arrays of LEDs, are positioned symmetrically with respect to the longitudinal vertical plane through the luminaire.

The described embodiment of the invention is an example only, and many other embodiments are possible within the scope of the invention.

The invention claimed is:

1. A luminaire for illuminating a space underneath a ceiling or a canopy to which the luminaire is attachable, said luminaire comprising a plurality of LEDs positioned in a linear array, and an associated elongated convergent lens having a plane of symmetry in the elongated direction, the elongated lens extending parallel to the array of LEDs, wherein centres of the LEDs are located at a distance (D) from said plane of symmetry of the associated elongated lens the luminaire further comprising fastening means for attaching the luminaire to the canopy or the ceiling, the fastening means being located in a plane of attachment of the luminaire, such that for the array of LEDs the angle between the plane of symmetry of the associated elongated lens and said plane of attachment is less than 90°, and the array of LEDs is located on the side of said plane of symmetry of the associated lens such that the lens is closer to the front side of the luminaire.

2. A luminaire as claimed in claim 1, wherein the lens facing away from the array of LEDs has a convex cylindrical surface.

3. A luminaire as claimed in claim 2, wherein the lens facing the array of LEDs has a concave cylindrical surface.

4. A luminaire as claimed in claim 3, wherein at least a part of each LED is located between the edges of the concave cylindrical surface of the elongated lens viewed in projection along the plane of symmetry.

5. A luminaire as claimed in claim 1, wherein the array of LEDs accommodates at least five LEDs.

6. A luminaire as claimed in claim 1, wherein the distance (D) between the centres of the array of LEDs and the plane of symmetry of the elongated lens is at least 1 mm, preferably at least 3 mm, said distance (D) being at most equal to half a width W of the elongated lens.

7. A luminaire as claimed in claim 1, comprising two parallel linear arrays of LEDs, wherein each array of LEDs is provided with a respective elongated lens having a respective plane of symmetry, and the two arrays of LEDs are located on different sides of said respective plane of symmetry of the lens with which the array of LEDs is associated.

8. A luminaire as claimed in claim 7, wherein the two planes of symmetry of the elongated lenses are positioned at an angle with respect to each other, which angle is between 8° and 28°.

9. A luminaire as claimed in claim 7, wherein the two planes of symmetry cross each other in a line behind the LEDs.

10. A luminaire as claimed in claim 7, wherein the luminaire has a plane of symmetry.

* * * * *